US005877142A

United States Patent [19]

Gross et al.

[11] Patent Number: 5,877,142

[45] Date of Patent: Mar. 2, 1999

[54] USE OF XANTHAN GUM TO IMPROVE GLOSS RETENTION OF SURFACTANTS AND SURFACTANT-BASED HARD SURFACE CLEANERS

[75] Inventors: Stephen F. Gross, Souderton; Timothy C. Morris, Morton, both of Pa.

[73] Assignee: Henkel Corporation, Gulph Mills, Pa.

[21] Appl. No.: 734,798

[22] Filed: Oct. 23, 1996

[51] Int. Cl.[6] ..... C11D 3/22; C11D 1/72; C11D 11/00; C11D 17/00

[52] U.S. Cl. ..... 510/421; 510/238; 510/413; 510/422; 510/470

[58] Field of Search ..... 252/239, 240; 510/470, 535, 413, 421, 422, 238

[56] References Cited

U.S. PATENT DOCUMENTS

| | | | |
|---|---|---|---|
| 3,970,594 | 7/1976 | Claybaugh | 510/438 |
| 4,532,066 | 7/1985 | Paszek et al. | 510/400 |
| 5,200,115 | 4/1993 | Giesen et al. | 510/320 |
| 5,254,284 | 10/1993 | Barone et al. | 510/181 |
| 5,364,551 | 11/1994 | Lentsch et al. | 510/100 |

FOREIGN PATENT DOCUMENTS

| | | |
|---|---|---|
| 727580 | 2/1966 | Canada . |
| 2-123193 | 5/1990 | Japan . |
| 7-188699 | 7/1995 | Japan . |
| 1 357 323 | 6/1974 | United Kingdom . |

OTHER PUBLICATIONS

English translation of JP 2–123193, Deguchi et al., published May 10, 1990, Sep. 1997.

English translation of JP 7–188699, Kizaki et al., published Jul. 25, 1995, Sep. 1997.

*Primary Examiner*—Ardith Hertzog

*Attorney, Agent, or Firm*—Ernest G. Szoke; Wayne C. Jaeschke; Steven J. Trzaska

[57] ABSTRACT

A surfactant composition having enhanced gloss retention properties containing from about 0.001 to about 3.0% by weight, based on the weight of the composition, of a gloss retention aid consisting of xanthan gum.

9 Claims, 1 Drawing Sheet

USE OF XANTHAN GUM TO IMPROVE GLOSS RETENTION OF SURFACTANTS AND SURFACTANT-BASED HARD SURFACE CLEANERS

FIELD OF THE INVENTION

The present invention generally relates to an improved cleaning composition for hard surfaces. More particularly, by incorporating a minor amount of a xanthan gum into a surfactant composition, significantly enhanced gloss retention is realized during the cleaning operation.

BACKGROUND OF THE INVENTION

Many cleaning compositions which satisfactorily remove soil and dirt from hard surfaces such as glass, ceramic tile, and stainless steel are also meant to impart a certain degree of gloss onto the object being cleaned. The retention time of the gloss on the objects, however, is typically very finite and after a short period of time the object tends to lose its shiny, glossy appearance.

It is therefore an object of the present invention to provide a means for prolonging the gloss retention time of hard surface cleaning compositions.

SUMMARY OF THE INVENTION

The present invention is directed to a surfactant composition containing from about 0.001 to about 3.0% by weight, based on the weight of the composition, of a gloss retention additive consisting of xanthan gum.

The present invention is also directed to a process for enhancing the gloss retention properties of a cleaning composition involving adding to the cleaning composition from about 0.001 to about 3.0% by weight, based on the weight of the composition, of a gloss retention additive consisting of xanthan gum.

The present invention also relates to a hard surface cleaning composition containing from about 0.001 to about 3.0% by weight, based on the weight of the composition, of a gloss retention additive consisting of xanthan gum.

The present invention also provides a process for improving gloss retention of hard surfaces involving contacting the hard surfaces with the above-disclosed cleaning composition.

DESCRIPTION OF THE INVENTION

Figure 1:
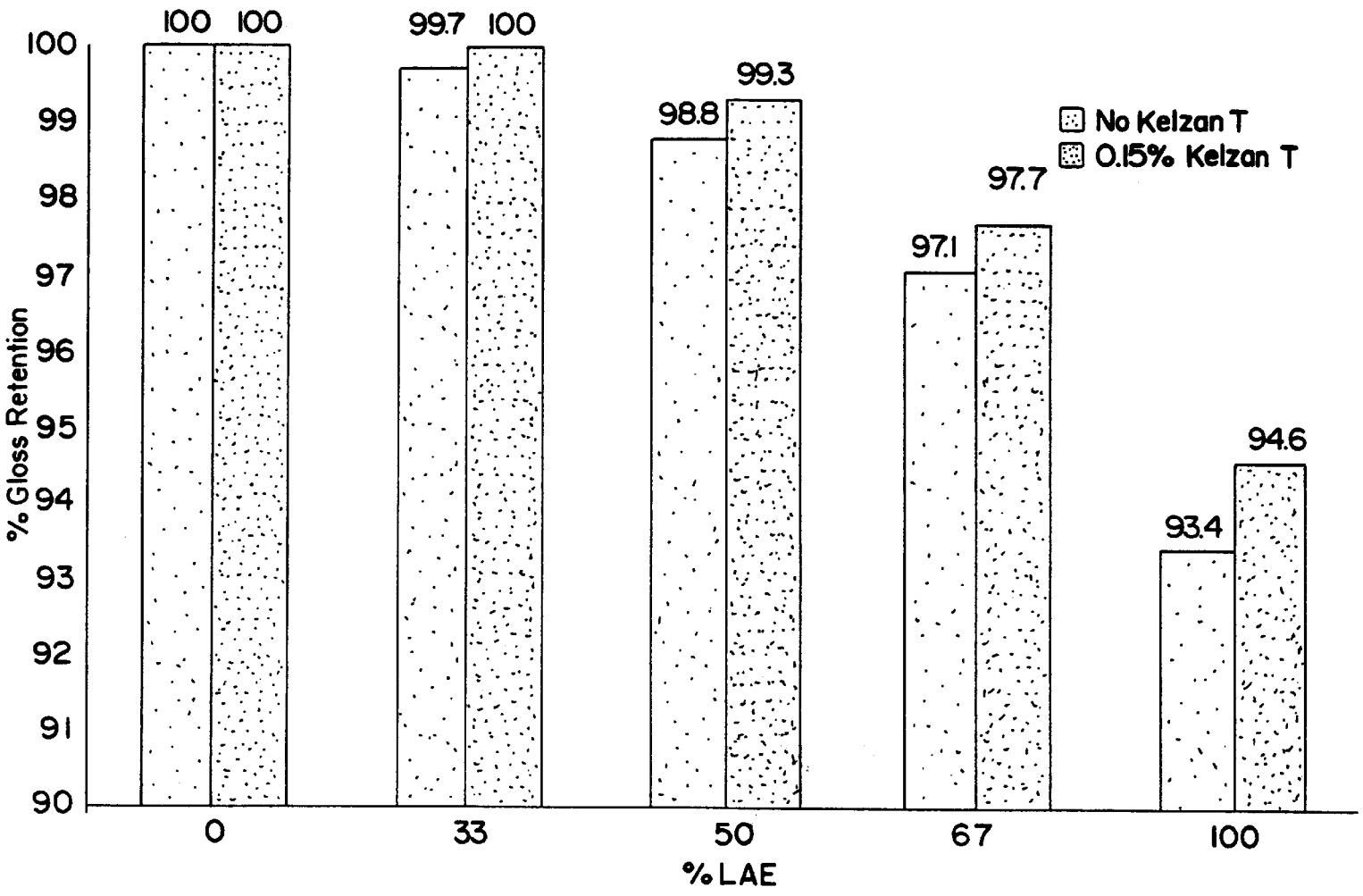
FIG. 1 is a bar graph illustrating the gloss retention properties of surfactant blends based on an alkyl polyglycoside and a linear alcohol ethoxylate, the blends containing varying amounts of xanthan gum.

Other than in the operating examples, or where otherwise indicated, all numbers expressing quantities of ingredients or reaction conditions used herein are to be understood as modified in all instances by the term "about".

The surprising discovery has been made that gloss retention properties of surfactant compositions can be improved by the addition of a minor amount of a gloss retention aid.

In general, the surfactants which may be present in the surfactant compositions of the present invention are selected from the group consisting of nonionic, anionic, amphoteric, cationic, zwitterionic surfactants, as well as mixtures thereof.

Anionic surfactants are broadly described as surface active compounds having one or more negatively charged functional groups. Included in this category is a $C_8$–$C_{22}$ alkyl fatty acid salt of an alkali metal, alkaline earth metal, ammonium, alkyl substituted ammonium or alkanolammonium salt. Sodium salts of tallow and coconut fatty acids and mixtures thereof are most common. Another important class of anionic compounds are the water-soluble salts, particularly the alkali metal salts, of organic sulfur reaction products having in their molecular structure an alkyl radical containing from about 8 to 22 carbon atoms and a radical selected from the group consisting of sulfonic and sulfuric acid ester radicals. Organic sulfur based anionic surfactants include the salts of $C_{10}$–$C_{16}$ alkylbenzene sulfonates, $C_{10}$–$C_{22}$ alkane sulfonates, $C_{10}$–$C_{22}$ alkyl ether sulfates, $C_{10}$–$C_{22}$ alkyl sulfates, $C_4$–$C_{10}$ dialkylsulfosuccinates, $C_{10}$–$C_{22}$ acyl isothionates, alkyl diphenyloxide sulfonates, alkyl naphthalene sulfonates, and 2-acetamido hexadecane sulfonates. Organic phosphate based anionic surfactants include organic phosphate esters such as complex mono- or diester phosphates of hydroxyl-terminated alkoxide condensates, or salts thereof. Included in the organic phosphate esters are phosphate ester derivatives of polyoxyalkylated alkylaryl phosphate esters, of ethoxylated linear alcohols and ethoxylates of phenol. A particularly preferred class of nonionics are the linear alcohol ethoxylates having from about 2 to about 12 ethylene oxide moieties.

Nonionic surfactants are broadly defined as surface active compounds with one or more uncharged hydrophilic substituents. A major class of nonionic surfactants are those compounds produced by the condensation of alkylene oxide groups with an organic hydrophobic material which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Examples of suitable nonionic surfactants include, but are not limited to, polyoxyethylene or polyoxypropylene condensates of aliphatic carboxylic acids, whether linear or branched-chain and unsaturated or saturated, containing from about 8 to about 18 carbon atoms in the aliphatic chain and incorporating from about 2 to about 50 ethylene oxide and/or propylene oxides units. Suitable carboxylic acids include coconut fatty acids which contain an average of 12 carbon atoms, tallow fatty acids which contain an average of about 18 carbon atoms, palmitic acid, myristic acid, stearic acid and lauric acid.

Another example of useful nonionic surfactants include polyoxyethylene or polyoxypropylene condensates for aliphatic alcohols, whether linear- or branched-chain and unsaturated or saturated, containing from about 6 to about 24 carbon atoms and incorporating from a bout 2 to about 50 ethylene oxide and/or propylene oxide units. Suitable alcohols include coconut fatty alcohol, tallow fatty alcohol, lauryl alcohol, myristyl alcohol and oleyl alcohol.

A particularly preferred class of nonionic surfactants are the alkyl polyglycosides of formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6. Preferred alkyl polyglycosides which can be used in the compositions according to the invention have the formula I wherein Z is a glucose residue and b is zero. Such alkyl polyglycosides are commercially available, for example, as APG®, GLUCOPON®, or PLANTAREN® surfactants from Henkel Corporation, Ambler, Pa., 19002. Examples of such surfactants include but are not limited to:

1. APG® 225 Surfactant—an alkyl polyglycoside in which the alkyl group contains 8 to 10 carbon atoms and having an average degree of polymerization of 1.7.
2. GLUCOPON® 425 Surfactant—an alkyl polyglycoside in which the alkyl group contains 8 to 16 carbon atoms and having an average degree of polymerization of 1.48.
3. GLUCOPON® 625 Surfactant—an alkyl polyglycoside in which the alkyl groups contains 12 to 16 carbon atoms and having an average degree of polymerization of 1.6.
4. APG® 325 CS Surfactant—an alkyl polyglycoside in which the alkyl groups contains 9 to 11 carbon atoms and having an average degree of polymerization of 1.5.
5. GLUCOPON® 600 Surfactant—an alkyl polyglycoside in which the alkyl groups contains 12 to 16 carbon atoms and having an average degree of polymerization of 1.4.
6. PLANTAREN® 2000 Surfactant—a $C_{8-16}$ alkyl polyglycoside in which the alkyl group contains 8 to 16 carbon atoms and having an average degree of polymerization of 1.4.
7. PLANTAREN® 1300 Surfactant—a $C_{12-16}$ alkyl polyglycoside in which the alkyl groups contains 12 to 16 carbon atoms and having an average degree of polymerization of 1.6.

Other examples include alkyl polyglycoside surfactant compositions which are comprised of mixtures of compounds of formula I wherein Z represents a moiety derived from a reducing saccharide containing 5 or 6 carbon atoms; a is a number having a value from 1 to about 6; b is zero; and $R_1$ is an alkyl radical having from 8 to 20 carbon atoms. The compositions are characterized in that they have increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and polyglycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in U.S. Pat. No. 5,266,690, the entire contents of which are incorporated herein by reference.

Other alkyl polyglycosides which can be used in the compositions according to the invention are those in which the alkyl moiety contains from 6 to 18 carbon atoms in which and the average carbon chain length of the composition is from about 9 to about 14 comprising a mixture of two or more of at least binary components of alkylpolyglycosides, wherein each binary component is present in the mixture in relation to its average carbon chain length in an amount effective to provide the surfactant composition with the average carbon chain length of about 9 to about 14 and wherein at least one, or both binary components, comprise a Flory distribution of polyglycosides derived from an acid-catalyzed reaction of an alcohol containing 6–20 carbon atoms and a suitable saccharide from which excess alcohol has been separated.

Amphoteric surfactants are broadly described as derivatives of aliphatic and tertiary amines, in which the aliphatic radical may be straight chain or branched and wherein one of the aliphatic substituents contain from about 8 to about 18 carbons and one contains an anionic water-solubilizing group, i.e., carboxy, sulpho, sulphato, phosphate or phosphono. Examples of such compounds are sodium 3-dodecylamino propionate and sodium 2-dodecylamino propane sulfonate.

Zwitterionic surfactants are broadly described as derivatives of aliphatic quaternary ammonium, phosphonium and suphonium compounds in which the aliphatic radical may be straight chained or branched, and wherein one of the aliphatic substituents contains from about 8 to about 18 carbon atoms and one contains an anionic water-solubilizing group, e.g., carboxy, sulpho, sulphato, phosphato or phosphono. These compounds are frequently referred to as betaines and include alkyl betaines, alkyl amino and alkyl amido betaines.

According to one aspect of the invention, there is provided a surfactant composition containing at least one surfactant selected from the group consisting of an anionic, a nonionic, a cationic, an amphoteric, a zwitterionic and mixtures thereof and from about 0.001 to about 3.0% by weight, based on the weight of the composition, of a gloss retention aid consisting of xanthan gum.

In a particularly preferred embodiment of the present invention, the surfactant components comprising the surfactant composition are nonionic surfactants, preferably a linear alcohol ethoxylate having from about 2 to about 12 ethylene oxide moieties in combination with an alkyl polyglycoside of formula I. The gloss retention aid is xanthan gum and it is preferably present in the surfactant composition in an amount of from about 0.05 to about 0.25% by weight, based on the weight of the composition.

According to another aspect of the present invention, there is provided a process for enhancing the gloss retention properties of a hard surface cleaning composition by adding thereto from about 0.001 to about 3.0% by weight, and preferably from about 0.05 to about 0.25% by weight, based on the weight of the hard surface cleaning composition, of the xanthan gum gloss retention aid. The addition of the gloss retention aid to the hard surface cleaning composition can be performed in any known conventional manner such as, for example, stirring.

The present invention is also directed to a hard surface cleaning composition having improved gloss retention properties. Hard surface cleaning compositions generally contain at least one of the above-disclosed surfactants, preferably a combination of a linear alcohol ethoxylate having from about 2 to about 12 ethylene oxide moieties and an alkyl polyglycoside of formula I, in combination with other additives known in the art. Examples of such additives include, but are not limited to, emulsifiers, fragrances, inert particulate fillers, stabilizers, bleach scavengers, soil suspending agents, antiredeposition agents, anti-tarnishing agents, anti-corrosion agents, and the like.

In one embodiment, there is thus provided a hard surface cleaning composition containing from about 0.001 to about 3.0, and preferably from about 0.05 to about 0.25% by weight, based on the weight of the cleaning composition, of a gloss retention aid consisting of xanthan gum.

Finally, the present invention also provides a process for imparting improved gloss retention properties onto hard surfaces which include, but are not limited to, ceramic tiles, glass and stainless steel. The process involves contacting the hard surfaces with the above-disclosed hard surface cleaning composition.

The present invention will be better understood from the examples which follow, all of which are intended to be illustrative only and not meant to unduly limit the scope of the invention. Unless otherwise indicated, percentages are on a weight-by-weight basis.

EXAMPLES

Surfactant solutions were prepared containing GLUCOPON® 425, an alkyl polyglycoside commercially available from Henkel Corporation, Ambler, Pa. and/or GENAPOL® 26-L-45, a linear alcohol ethoxylate commercially available from Hoechst, at 17.75% total actives. The ratio of alkyl polyglycoside:linear alcohol ethoxylate varied from 1:0 to 2:1 to 1:1 to 1:2 to 0:1. These surfactant blends were then diluted with deionized water at a ratio of surfactant blend:water of 1:64.

The same five surfactant blends were then made a second time, replacing 0.15% water with KELZAN® T, a xanthan gum commercially available from Kelco Corporation.

Test Procedure:

(1) Four black ceramic tiles were washed with a detergent solution using a sponge, and were then manually dried using kimwipes.

(2) The gloss of each of the tiles was than measured using a Gardner Micro-Tri-Gloss at 20°. Ten measurements were made on each tile and then averaged to yield an initial gloss for each tile. The initial gloss measurements for each tile were then averaged to determine the average initial gloss.

(3) Using a disposable pipet, 15 drops of the test surfactant blends, with and without xanthan gum, were then placed on four black ceramic tiles.

(4) Light pressure was then applied, spreading the test solution over the tile surface by 20 cycles with a kimwipe.

(5) Light pressure was then again applied, for 20 cycles with a fresh kimwipe, after which the tile was allowed to air dry for approximately 10 minutes.

(6) Final gloss measurements were then taken on the tiles as in step (2) above. The final gloss measurements were then averaged to determine the average final gloss.

(7) Gloss retention was then calculated per the following equation: % Gloss Retention=(avg. final gloss/avg. initial gloss)×100, the results of which are found in FIG. 1.

What is claimed is:

1. A hard surface cleaning composition having enhanced gloss retention properties comprising from about 0.05 to about 0.25% by weight, based on the weight of the composition, of a gloss retention aid consisting of xanthan gum, and at least one nonionic surfactant consisting of a linear alcohol ethoxylate having from about 2 to about 12 ethylene oxide moieties.

2. The composition of claim 1 wherein the cleaning composition further contains at least one surfactant selected from the group consisting of an anionic, a nonionic other than the linear alcohol of claim 1, a cationic, an amphoteric, a zwitterionic, and mixtures thereof.

3. The composition of claim 2 wherein the nonionic surfactant is an alkyl polyglycoside corresponding to formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6.

4. A process for enhancing the gloss retention properties of a cleaning composition comprising adding to the cleaning composition from about 0.05 to about 0.25% by weight, based on the weight of the composition, of a gloss retention aid consisting of xanthan gum, wherein the cleaning composition comprises at least one nonionic surfactant consisting of a linear alcohol ethoxylate having from about 2 to about 12 ethylene oxide moieties.

5. The process of claim 4 wherein the cleaning composition further contains at least one surfactant selected from the group consisting of an anionic, a nonionic other than the linear alcohol of claim 4, a cationic, an amphoteric, a zwitterionic, and mixtures thereof.

6. The process of claim 5 wherein the nonionic surfactant is an alkyl polyglycoside corresponding to formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6.

7. A process for improving gloss retention of a hard surface comprising contacting the hard surface with a cleaning composition containing from about 0.05 to about 0.25% by weight, based on the weight of the composition, of a gloss retention aid consisting of xanthan gum, wherein the cleaning composition comprises at least one nonionic surfactant consisting of a linear alcohol ethoxylate having from about 2 to about 12 ethylene oxide moieties.

8. The process of claim 7 wherein the cleaning composition further contains at least one surfactant selected from the group consisting of an anionic, a nonionic other than the linear alcohol of claim 7, a cationic, an amphoteric, a zwitterionic, and mixtures thereof.

9. The composition of claim 8 wherein the nonionic surfactant is an alkyl polyglycoside corresponding to formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6.

* * * * *